US008607367B2

(12) United States Patent
Jones

(10) Patent No.: US 8,607,367 B2
(45) Date of Patent: Dec. 17, 2013

(54) UNDERGARMENT

(76) Inventor: Darnell Jones, Dallas, TX (US)

( * ) Notice: Subject to any disclaimer, the term of this patent is extended or adjusted under 35 U.S.C. 154(b) by 195 days.

(21) Appl. No.: 13/076,755

(22) Filed: Mar. 31, 2011

(65) Prior Publication Data

US 2012/0246805 A1 Oct. 4, 2012

(51) Int. Cl.
*A41B 9/02* (2006.01)
*A41B 9/00* (2006.01)

(52) U.S. Cl.
USPC ..... 2/400; 2/315

(58) Field of Classification Search
USPC ..... 2/78.4, 112, 217, 315, 335, 306, 300, 2/314, 304, 400–407, 107, 109, 117, 229, 2/307, 230, 312, 340; 450/110
See application file for complete search history.

(56) References Cited

U.S. PATENT DOCUMENTS

| | | | | | |
|---|---|---|---|---|---|
| 148,193 | A | * | 3/1874 | Dunbar | 2/229 |
| 265,524 | A | * | 10/1882 | Lyon | 2/229 |
| 321,654 | A | * | 7/1885 | Stark | 2/229 |
| 388,075 | A | * | 8/1888 | Saeger | 2/229 |
| 839,553 | A | * | 12/1906 | Cohn | 2/311 |
| 925,121 | A | * | 6/1909 | Melze | 602/67 |
| 932,640 | A | * | 8/1909 | Pfiffner | 2/70 |
| 1,169,500 | A | * | 1/1916 | Mink et al. | 2/402 |
| 1,817,360 | A | * | 8/1931 | Fridolph | 2/407 |
| 1,883,341 | A | * | 10/1932 | Dauphinais | 2/404 |
| 1,896,681 | A | | 2/1933 | Peckham | |
| 2,040,635 | A | * | 5/1936 | Sobel | 24/478 |
| 2,508,049 | A | | 5/1950 | Tuck | |
| 2,530,850 | A | * | 11/1950 | Atchley | 2/306 |
| 2,591,423 | A | * | 4/1952 | Grolitzer | 450/104 |
| 3,331,372 | A | | 7/1967 | Klein | |
| 3,418,659 | A | * | 12/1968 | Brown | 2/70 |
| 3,542,034 | A | | 11/1970 | Klein | |
| 4,074,364 | A | | 2/1978 | Lucero | |
| 4,596,569 | A | | 6/1986 | Campbell | |
| 4,597,109 | A | | 7/1986 | Hironaga | |
| 4,853,979 | A | * | 8/1989 | Ryder | 2/326 |
| 4,937,886 | A | | 7/1990 | Ellis | |
| 5,012,802 | A | * | 5/1991 | Bischoff | 602/73 |
| 5,177,813 | A | | 1/1993 | Bosack et al. | |
| 5,276,923 | A | | 1/1994 | Cohen | |
| 5,313,669 | A | | 5/1994 | Rasdell et al. | |
| 5,819,381 | A | | 10/1998 | Lake | |
| 5,884,371 | A | | 3/1999 | Huggins | |
| 2010/0095433 | A1 | * | 4/2010 | Turkbas | 2/228 |
| 2010/0235969 | A1 | | 9/2010 | Isaacson et al. | |

* cited by examiner

*Primary Examiner* — Amy Vanatta
(74) *Attorney, Agent, or Firm* — JP Webb; Jason P. Webb; Danny Y. H. Cheng

(57) ABSTRACT

An undergarment configured to secure a second garment thereto, including an undergarment shaped to be worn about the hip region of a user. The undergarment includes a loop system extending outwardly from a non-crotch area of the undergarment and including a plurality of anchor modes having differing heights up the undergarment. The undergarment includes an attachment member coupled to the loop system, including a clip and a coupling device coupled to the clip and selectably coupleable to the loop system at the anchor modes. The loop system further includes an elongated member coupled vertically to the undergarment at a plurality of spaced positions, thereby forming successive independent loops The undergarment includes a length adjustment device configured to selectably adjust an effectual height of the clip extending therefrom. The loop system further includes a plurality of successive independent loops.

16 Claims, 11 Drawing Sheets

UNDERGARMENT

BACKGROUND OF THE INVENTION

1. Field of the Invention

The present invention relates to clothing, specifically to an undergarment configured to cover the hips of a user.

2. Description of the Related Art

Undergarments or underwear are clothes worn under other clothes, often next to the skin. They keep outer garments from being soiled by bodily secretions and discharges, shape the body, and provide support for parts of it. Undergarments commonly worn by women today include brassieres and panties (also known as knickers), while men often wear briefs, boxer shorts, and boxer briefs.

A shirt, or dress shirt is a garment with a collar, a full-length opening at the front from the collar to the hem, and sleeves with cuffs. Shirts are predominantly used by men, since women usually wear blouses. The front opening is fastened using buttons or studs, and the cuffs close with buttons or cuff links. Shirts are normally made from woven cloth, and are often accompanied by a jacket and tie, for example with a suit or formalwear, but shirts are also worn more casually. Some of these formal shirts have stiff fronts and detachable collars attached with collar studs. Dress shirts are usually tucked into pants to present a professional look, however dress shirts typically move and pull out from the pants, thereby creating an undesired sloppy or messy look. There is a need of an undergarment that supports and secures the dress shirt thereto. Some improvements have been made in the field. Examples of references related to the present invention are described below in their own words, and the supporting teachings of each reference are incorporated by reference herein:

U.S. Pat. No.: 5,884,371, issued to Huggins, discloses a dressing aid for suspending a lower garment from an upper garment is disclosed herein comprising a band and a pair of clips, with one clip connected to each end of the band. Each clip comprises a pair of arms each having a handle at a first end and a jaw at a second end, a pivoting means, and a means for biasing the jaws to the closed position. One may engage a garment using the clip by squeezing together the handles such that the jaws separate, then releasing the handles to close the jaws about a garment positioned therebetween. It is contemplated that one will employ the present apparatus to aid in donning a lower garment using the following steps: assuming a seated position with the lower garment pulled up past one's knees; manually squeezing the handles of one clip together to separate its jaws, positioning the jaws about a portion of the upper garment and then releasing the handles to close the jaws and engage the upper garment; manually squeezing the handles of the other clip together to separate its jaws and to likewise engage a portion of the lower garment; and finally standing erect, with the lower garment suspended from said upper garment, and fastening the lower garment into place.

U.S. Pat. No.: 5,313,669, issued to Rasdell et al., discloses a new and improved clothing anchor apparatus, especially useful for anchoring the front and back tails of shirts, includes a first clothing connector, a second clothing connector, and an elastic strap connected therebetween. The elastic strap has a first end, an interior portion, and a second end. A strap length adjuster is located on the interior portion of the strap for adjusting the effective length of the strap. The effective length of the strap is adjusted by adjustingly doubling a portion of the strap. A soft, flexible jacket encompasses a portion of the elastic strap and the strap length adjuster. The jacket may also include a pocket for receiving and secretly storing soft, flexible items such as paper money. In use, preferably, two clothing anchor apparatuses of the invention are used. One clothing connector of each apparatus is attached to the front shirt tail, and the other clothing connector of each apparatus is attached to the back shirt tail by first passing under the crotch area. The soft, flexible jacket provides comfortable contact with the crotch area. The apparatuses of the invention serve to pull the shirt tails downwardly, giving the shirt a neat appearance and preventing the shirt tails from becoming untucked from pants that are worn.

U.S. Pat. No.: 5,276,923, issued to Cohen, discloses a central elastomeric web, having concave sides to accommodate an individual's groin area, includes the central web to provide a plurality of tether webs extending longitudinally beyond the central web, with each tether web including a latch fastener for securement to a perimeter portion of an individual's shirt in use.

U.S. Pat. No.: 4,074,364, issued to Lucero, discloses A hold-down device for shirts, blouses, etc., comprising an elastic hipband to be worn around the hips, elastic front and rear flaps secured to the hipband and converging downwardly to fit the crotch of the wearer. Upstanding tabs are spaced around the hipband with means for securing the lower portion of a shirt to the tabs.

U.S. Pat. No.: 4,596,569, issued to Campbell, discloses A shirt hold-down device for diaper-wearing infants and toddlers, having an elongated elastic unit fitting between the legs over the diaper or diaper holder and having garter-type fasteners on each end for gripping the shirt.

The inventions heretofore known suffer from a number of disadvantages which include being expensive, being limited in use, being limited in application, being uncomfortable to wear, being non-adjustable, being inefficient, being ineffective, being too complex, causing the underwear to bunch around a crotch area of a user, pulling too tightly against a shirt and thereby causing an unnatural appearance, and being burdensome to use.

What is needed is an undergarment that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available undergarment. Accordingly, the present invention has been developed to provide an undergarment configured to selectably couple to a second garment.

According to one embodiment of the invention, there is an undergarment configured to secure a second garment thereto. The undergarment may include an undergarment that may be shaped to be worn about the hip region of a user. The undergarment may include a loop system that may extend outwardly from a non-crotch area of the undergarment and may include a plurality of anchor modes that may have differing heights up the undergarment. The loop system may include a plurality of successive independent loops. The undergarment may include an attachment member that may be coupled to the loop system. The attachment member may include a clip that may be configured to selectably couple to a second garment. The attachment member may also include a split ring that may be coupled to the clip and that may be selectably coupleable to the loop system at the anchor modes.

According to one embodiment of then invention, there is a loop system may further include an elongated member that may be coupled vertically to the undergarment at a plurality of spaced positions, thereby forming successive independent loops. The elongated member may include an internal attachment device configured to selectably attach to the undergarment. The internal attachment device may be detached, thereby connecting the successive independent loops.

According to one embodiment of the invention, there is a loop system further includes an elongated member coupled to the undergarment at a first end and having a second end including a loop. The second end may include a length adjustment device configured to selectably adjust an effectual height of the clip extending therefrom.

According to one embodiment of the invention, there is a loop system that may include a plurality of elongated members, that each may have a first end and a second end. Each of the first ends of the plurality of elongated members may be coupled on the undergarment at a same location. Each of the second ends of the plurality of elongated members may have a different effective height.

According to one embodiment of the invention, there is a loop system that may include a plurality of loops that may extend from a pair of front portions and from a pair of back portions of the undergarment.

According to one embodiment of the invention, there is an undergarment configured to secure a second garment thereto. The undergarment may include an undergarment that may be shaped to be worn about the hip region of a user. The undergarment may include a loop system that may extend outwardly from a non-crotch area of the undergarment and may include a plurality of anchor modes having differing heights up the undergarment. The undergarment may include an attachment member that may be coupled to the loop system. The attachment member may include a first coupling device configured to selectably couple to a second garment. The attachment member may include a second coupling device that may be coupled to the clip and that may be selectably coupleable to the loop system at the anchor modes.

According to one embodiment of the invention, there is an undergarment configured to secure a second garment thereto. The undergarment may include an undergarment that may be shaped to be worn about the hip region of a user. The undergarment may include a loop system that may extend outwardly from a non-crotch area of the undergarment and may include a plurality of anchor modes having differing heights up the undergarment. The undergarment may include an attachment member that may be coupled to the loop system. The attachment member may include a clip configured to selectably couple to a second garment. The attachment member may include a coupling device that may be coupled to the clip and that may be selectably coupleable to the loop system at the anchor modes.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
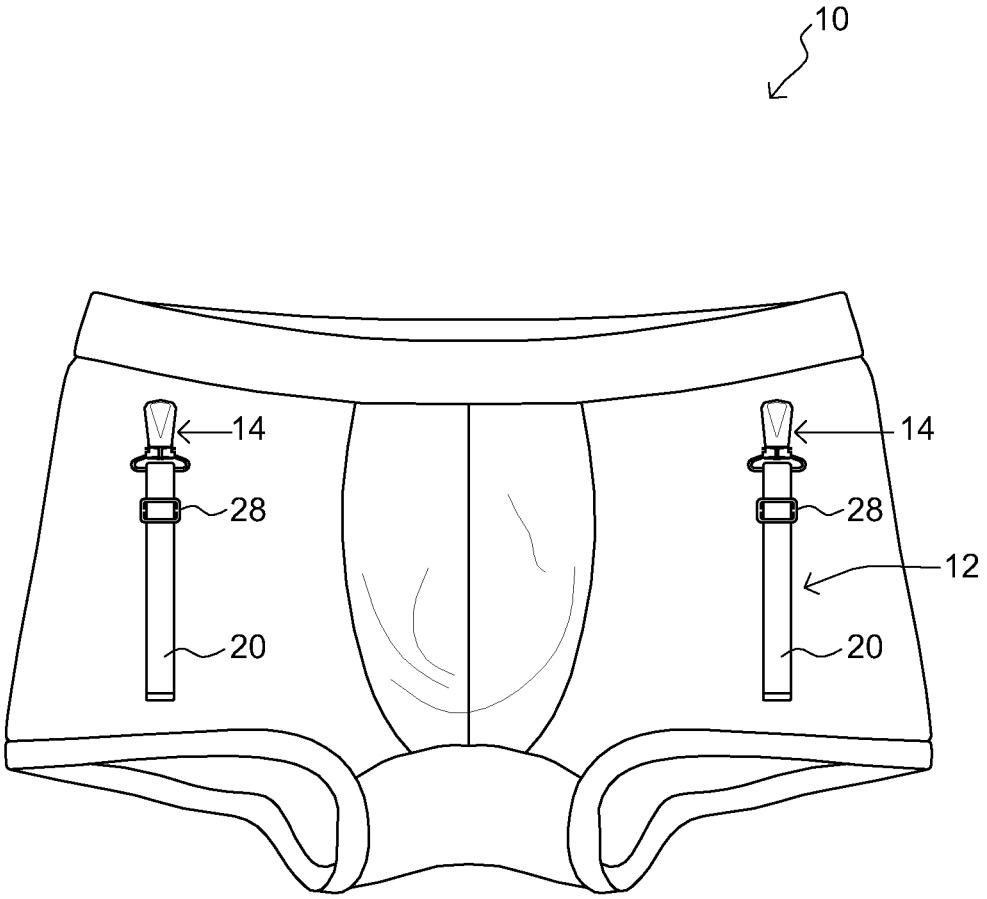
FIG. 1 is a front elevational view of an undergarment, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Figure 2:
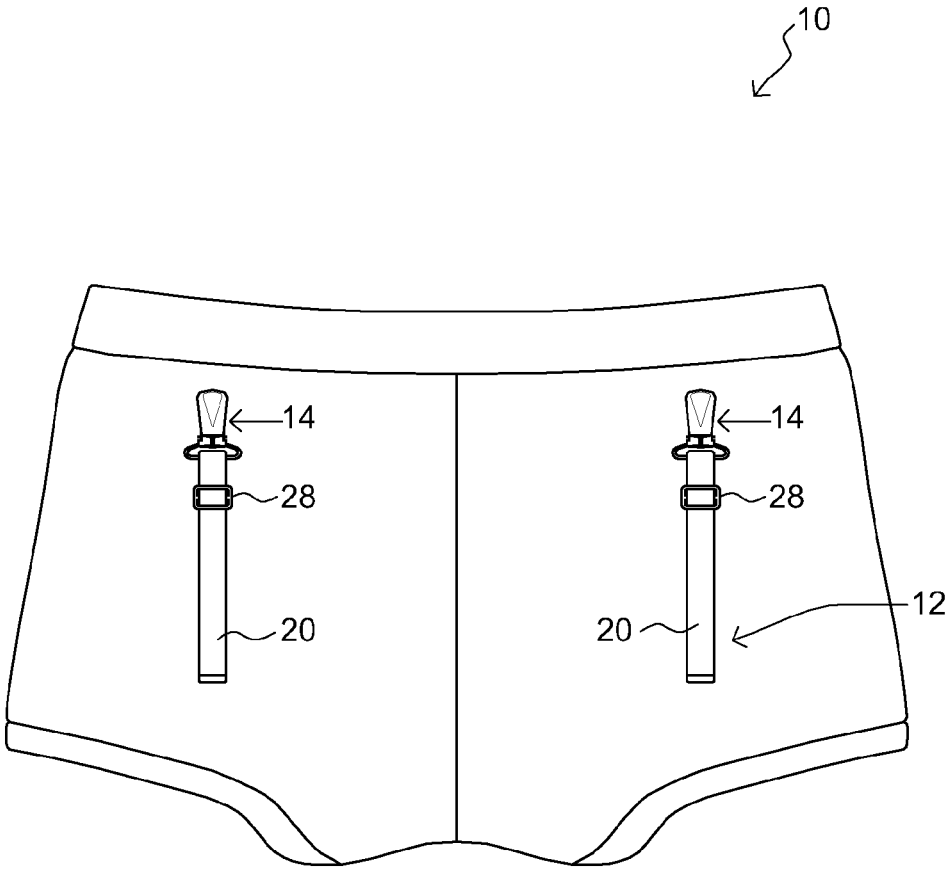
FIG. 2 is a rear elevational view of an undergarment, according to one embodiment of the invention.
Figure 3:
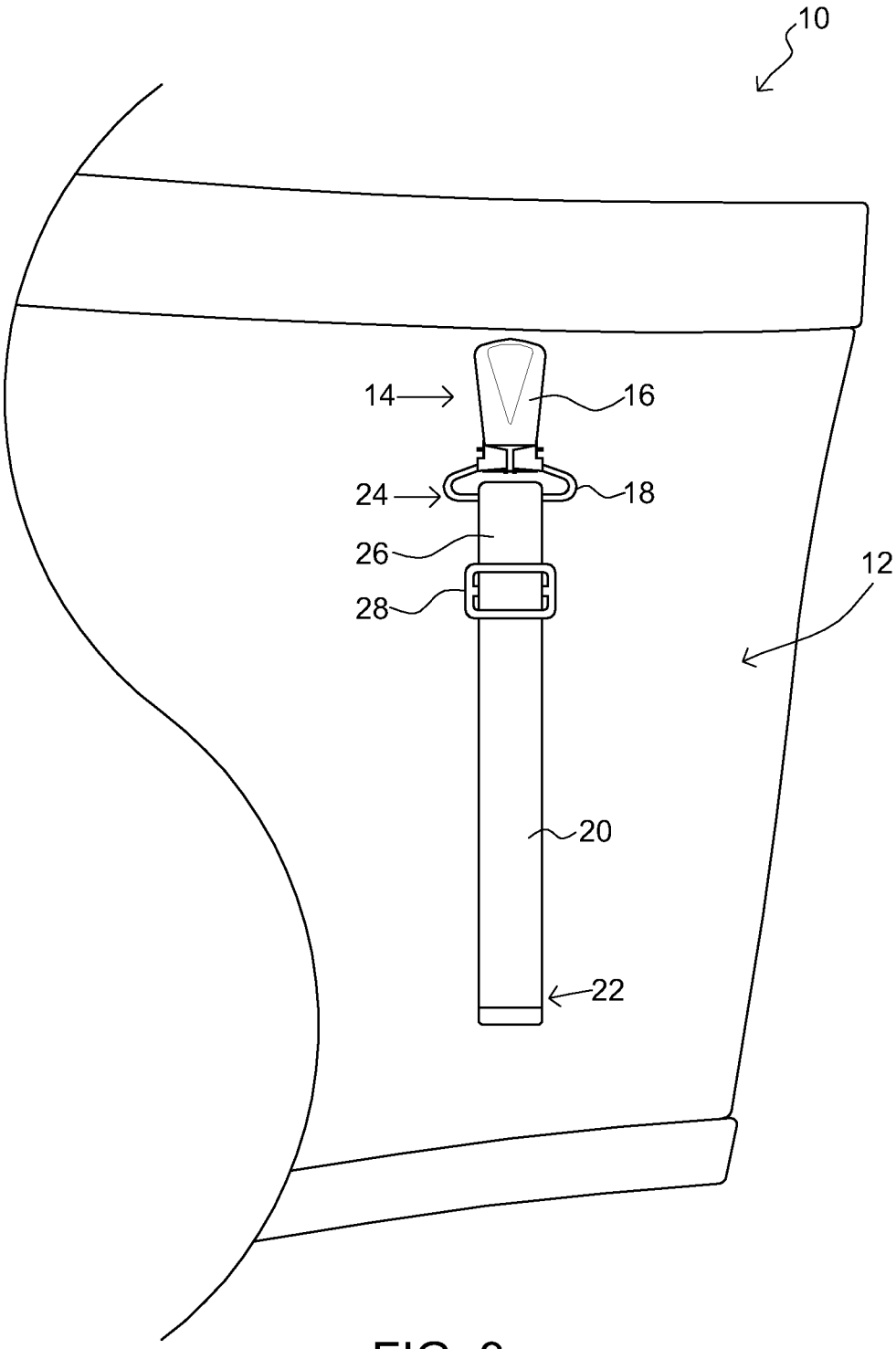
FIG. 3 is a partial side elevational view of an undergarment, according to one embodiment of the invention.

FIGS. 1-3 illustrate a front elevational view, a rear perspective view, and a partial side elevational view of an undergarment, according to one embodiment of the invention. There is shown an undergarment 10, a loop system 12, and an attachment member 14.

The illustrated undergarment 10 is a pair of boxer shorts configured to secure a second garment thereto, such as but not limited to a shirt. The undergarment 10 is shaped to be worn about a hip region of a user. Non-limiting examples of an undergarment may be: boxers, briefs, long johns, G-string, thongs, boy shorts, knickers, trunks, slips, religious garments, etc. The undergarment includes a crotch area centrally located and configured to cover a crotch of a user in operation. The crotch region includes portions intended to cover the genital region, the anus and the perineum of the user. The crotch region of a user is generally of heightened sensitivity to pain and discomfort. The undergarment also includes buttock, thigh and waist regions configured to cover portions of the buttocks, thighs and waist, respectively.

The undergarment 10 includes a loop system 12 extending outwardly from a non-crotch area of the undergarment 10. Advantageously, the loop system thereby avoids causing bunching, pinching, or otherwise undesirably interacting with a crotch region of the user. The illustrated loop system 12 includes a plurality of elongated members 20 extending from a pair of front portions, as illustrated in FIG. 1, and from a pair of back portions, as illustrated in FIG. 2, of the undergarment 10. The undergarment 10 includes an attachment member 14 coupled to the loop system 12. As illustrated in FIG. 3, the attachment member 14 includes a clip 16 configured to selectably couple to a second garment. The illustrated attachment member 14 also includes a split ring 18 coupled to the clip 16 and selectably coupleable to the loop system 12. The split ring 18 includes a split (not shown) whereby the loop may be fed through to selectably engage/disengage the clip to the loop. Other devices for selectably engaging/disengaging the attachment member to the loop system are contemplated, including but not limited to hook and loop, clips, snaps, buttons, adhesives, magnetics, pincers, clamps, double clips, double-sided clips, double-ended clips, and the like.

As illustrated in FIGS. 1-3, the loop system 12 includes an elongated member 20 coupled vertically to the undergarment 10. The illustrated elongated member 20 is configured to dangle down, when not coupled to a second garment, such as a shirt. The illustrated elongated member 20 is configured to extend upwards towards a waist region of a user, when coupled to a second garment. The illustrated elongated member 20 is coupled (in the illustrated example, stitched) to the undergarment 10 at a first end 22. The elongated member 20 includes a second end 24 including a loop 26. The loop 26 is configured to couple to the split ring 18 of the attachment member 14, thereby securing the attachment member 14 thereto. The illustrated elongated member 20 includes a length adjustment device 28, attached thereto, configured to selectably adjust an effectual height of the clip 16 extending therefrom, by adjusting the length of the elongated member 20. Accordingly, a user may selectably adjust the effective length/height of the elongated member thereby permitting use by users of varying proportions and wearing varying clothing articles. One non-limiting example of a length adjustment device may be a strap adjusting device as described in U.S. Pat. No. 4,077,091, issued to Liljedahl, which is hereby incorporated for its supported teachings herein. Non-limiting examples of length adjustment devices include looped-back hook and loop strips, spaced snaps/buttons, spaced knots, clips/hooks and spaced rings, and the like.

In operation of one embodiment of the invention, a user wears the undergarment 10 about the hip region of the user. The user wears and buttons up a shirt about a chest and upper body region of the user. The user selectably adjusts the adjustment member 28 on the elongated members 20 of the loop system 12. The user slides the adjustment member 28 along the elongated member 20 and adjusts the elongated members 20, so that the clip 16, of the attachment member 14, extending therefrom is in contact with the shirt. The user couples the clips 16 of the loop system 12 to the shirt. The user wears pants to cover the undergarment from view, and thereby securing the shirt, thereto, so the shirt does not freely move therefrom. The user may sit down and move around without having to re-tuck the shirt in or worry about the shirt pulling out from the pants.

Figure 4:
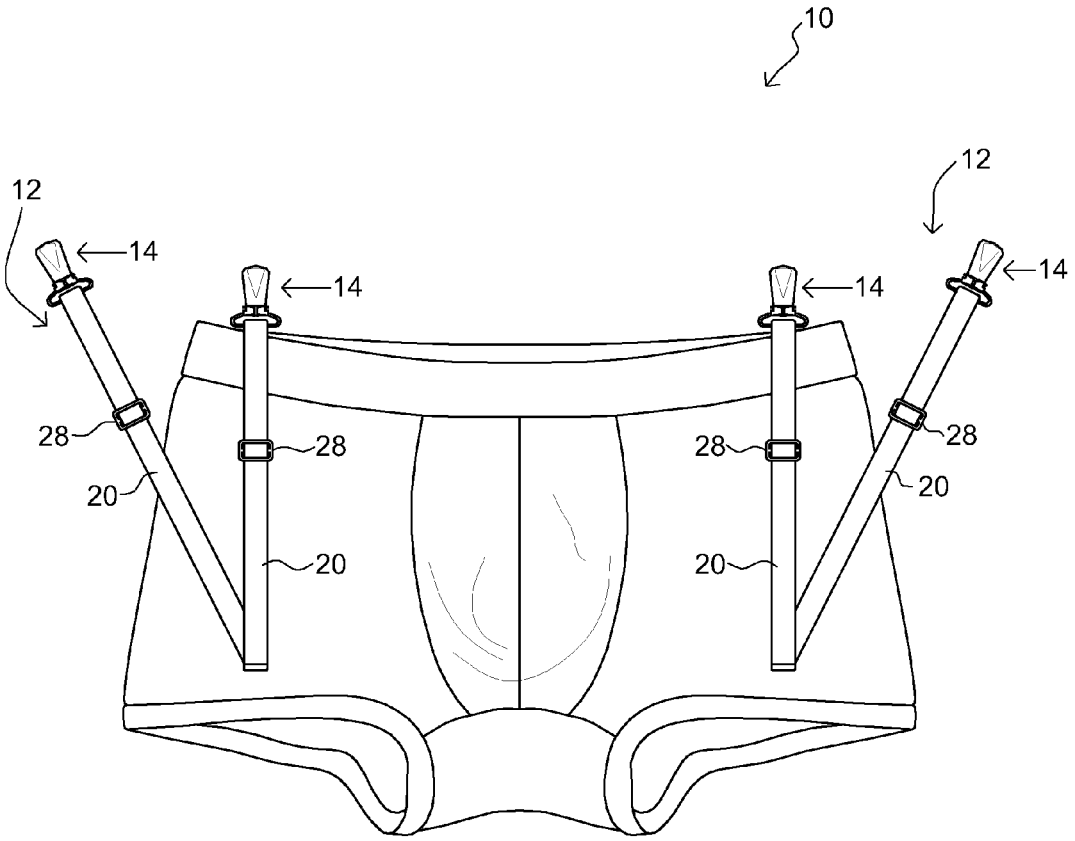
FIG. 4 is a front elevational view of an undergarment, according to one embodiment of the invention.
Figure 5:
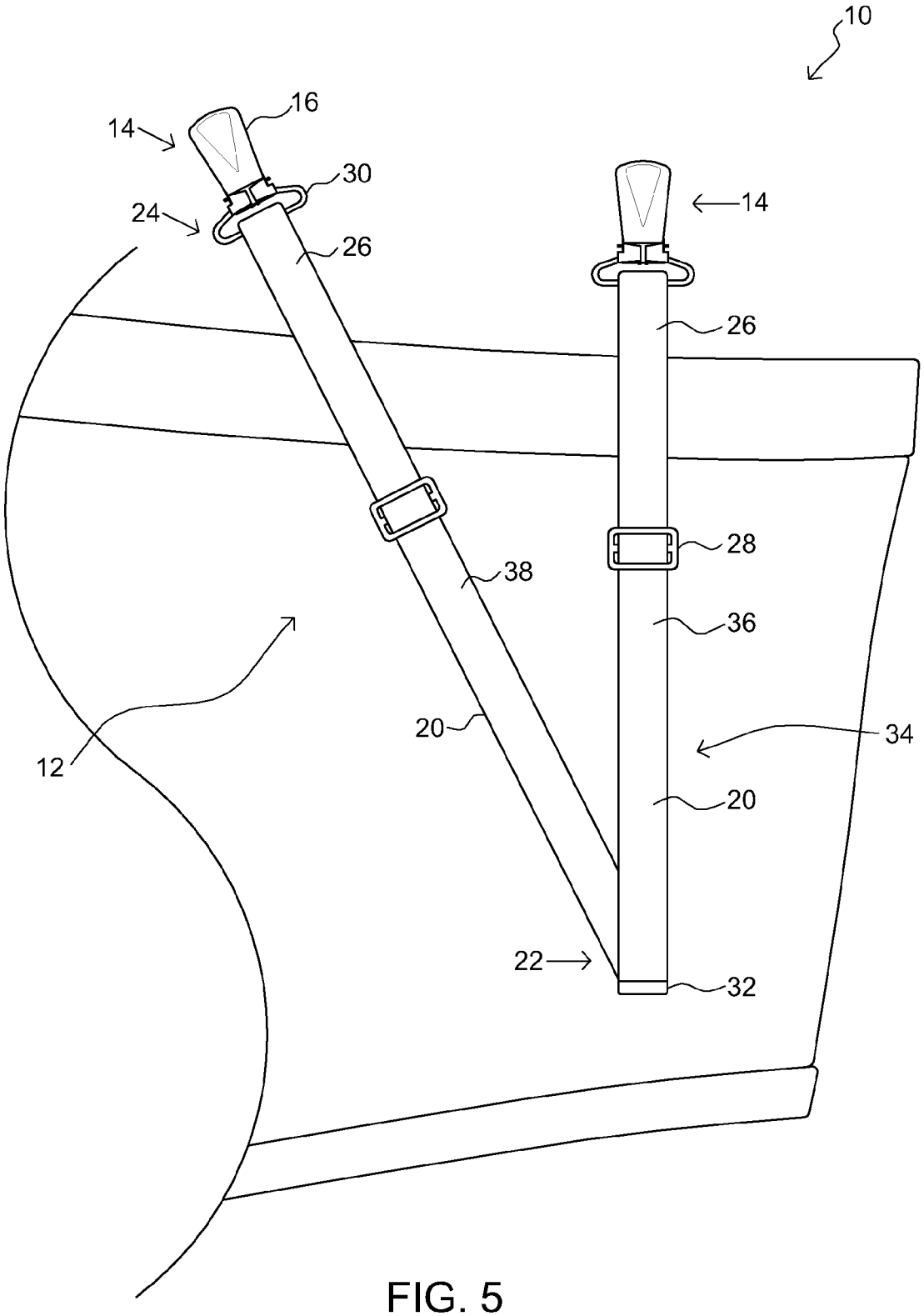
FIG. 5 is a partial side elevational view of an undergarment, according to one embodiment of the invention.

FIGS. 4 and 5 illustrate a front elevational view and a partial side elevational view of an undergarment, according to one embodiment of the invention. The undergarment 10 includes a loop system 12 and an attachment member 14 configured to couple to a second garment, such as a shirt.

The illustrated undergarment 10 includes a loop system 12 extending outwardly from a non-crotch area of the undergarment 10. The illustrated loop system 12 extends from a pair of front portions of the undergarment 10. The illustrated loop system 12 includes a plurality of paired elongated members with each member of each pair extending from substantially identical positions from the exterior surface of the undergarment, such that each member of the pair is characterized by having the same pivot point. The undergarment 10 includes an attachment member 14 coupled to the loop system 12. The attachment member 14 includes a clip 16 configured to selectably couple to a second garment. The attachment member 14 also includes a coupling device 30 coupled to the clip 16 and selectably coupleable to the loop system 12. Non-limiting examples of a coupling device may be snaps, buttons, hooks, loops, clips, straps, adhesives, magnets, pins, etc.

The loop system 12 includes a plurality of elongated members 20 each having a first end 22 and a second end 24. Each of the first ends 22 of the plurality of elongated members 20 is coupled on the undergarment 10 at a same frontal location 32. Each of the second ends 24 of the plurality of elongated members 20 includes a loop 26 configured to selectably couple to the attachment member 14. Each elongated member 20 includes a length adjustment device 28 configured to adjust the elongated members 20 to different effective heights, thereby adjusting the height of the attachment members 14 coupled thereto.

As illustrated in FIGS. 4 and 5, the elongated members 20 are coupled to the undergarment 10 at the same frontal location 32. The elongated members 20 are configured to couple to the same front location 32 is a V-type configuration 34. As illustrated in FIG. 5, a first elongated member 36 is configured to couple to a front portion of a shirt, and a second elongated member 38 is configured to couple to a back portion of a shirt.

Figure 6:
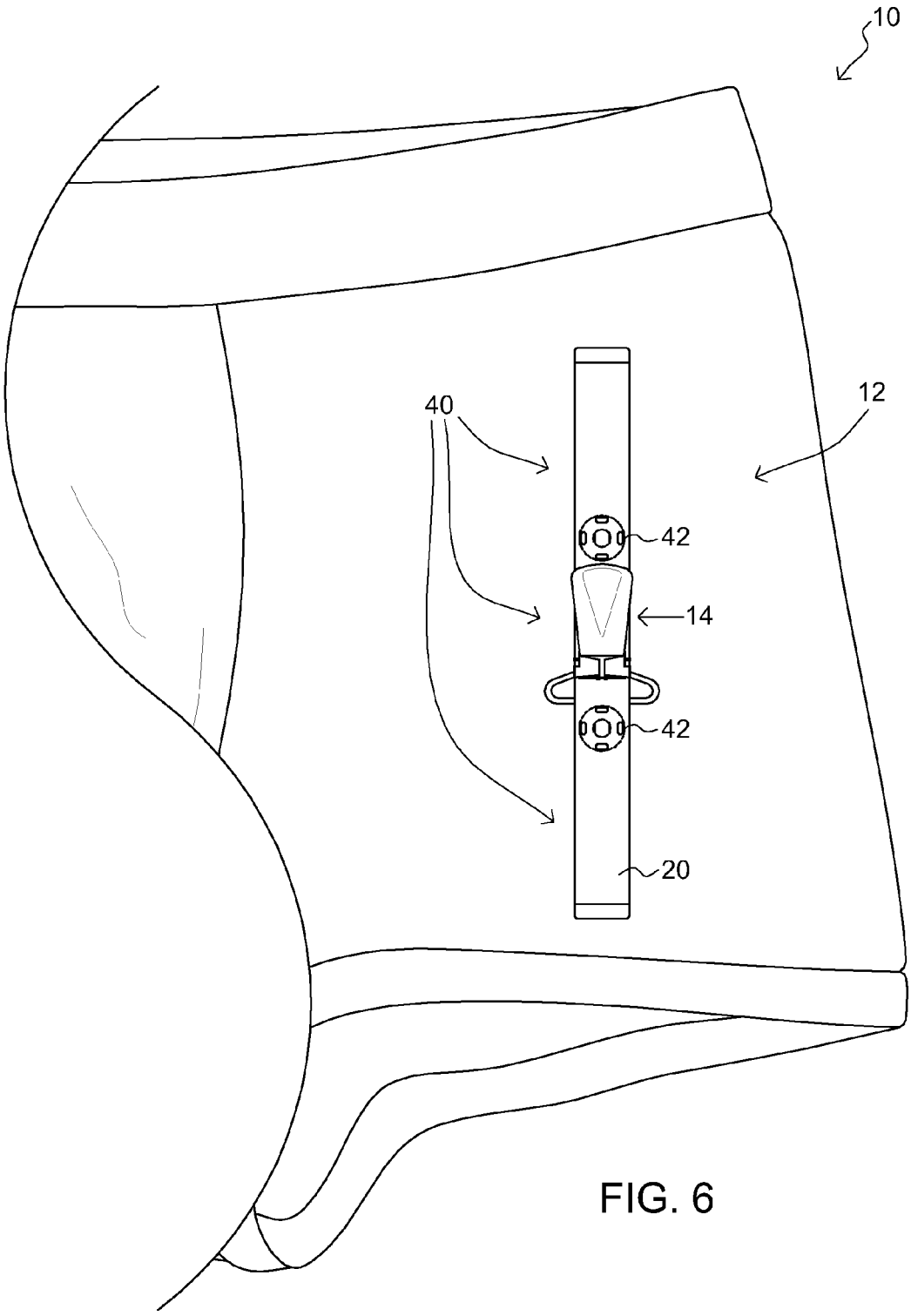
FIG. 6 is a partial front elevational view of an undergarment, according to one embodiment of the invention.

FIG. 6 is a partial front elevational view of an undergarment, according to one embodiment of the invention. There is shown an undergarment 10 including a loop system 12 and an attachment member 14 configured to secure a second garment thereto.

The illustrated undergarment 10 is configured to be worn about the hip region of a user. The undergarment 10 includes a loop system 12 extending outwardly from a non-crotch area of the undergarment 10. The loop system 12 includes a plurality of anchor modes 40 configured to provide differing attachment heights up the undergarment 10. The undergarment 10 includes an attachment member 14 coupled to the loop system 12. The attachment member 14 includes a clip configured to selectably couple to a second garment and a coupling device coupled to the clip and configured to selectably coupleable to the loop system 12.

The illustrated attachment member 14 is configured to couple to the loop system 12 at one of the plurality of anchor modes 40, wherein the attachment member 14 is configured to attach thereto and move there between. The illustrated loop system 12 includes an elongated member 20 coupled vertically to the undergarment 10 at a plurality of spaced positions, thereby forming successive independent loops. The elongated member 20 includes an internal attachment device 42 configured to selectably attach to the undergarment 10. The internal attachment device 42 may be detached, thereby connecting the successive independent loops into one independent loop, as illustrated in FIG. 6, the internal attachment device 42 separates the elongated member 20 into the plurality of anchor modes 40. The illustrated internal attachment devices 42 are matching snaps that are coupled to the exterior surface of the undergarment and to the elongated member. Accordingly, a user may selectably couple/decouple snaps in a manner that permits usage/access to the anchor modes 40 by the attachment member 14. The elongated members 20 of the loop system 12 is configured to extend from a pair of front portions and from a pair of back portions of the undergarment 10.

Figure 7:
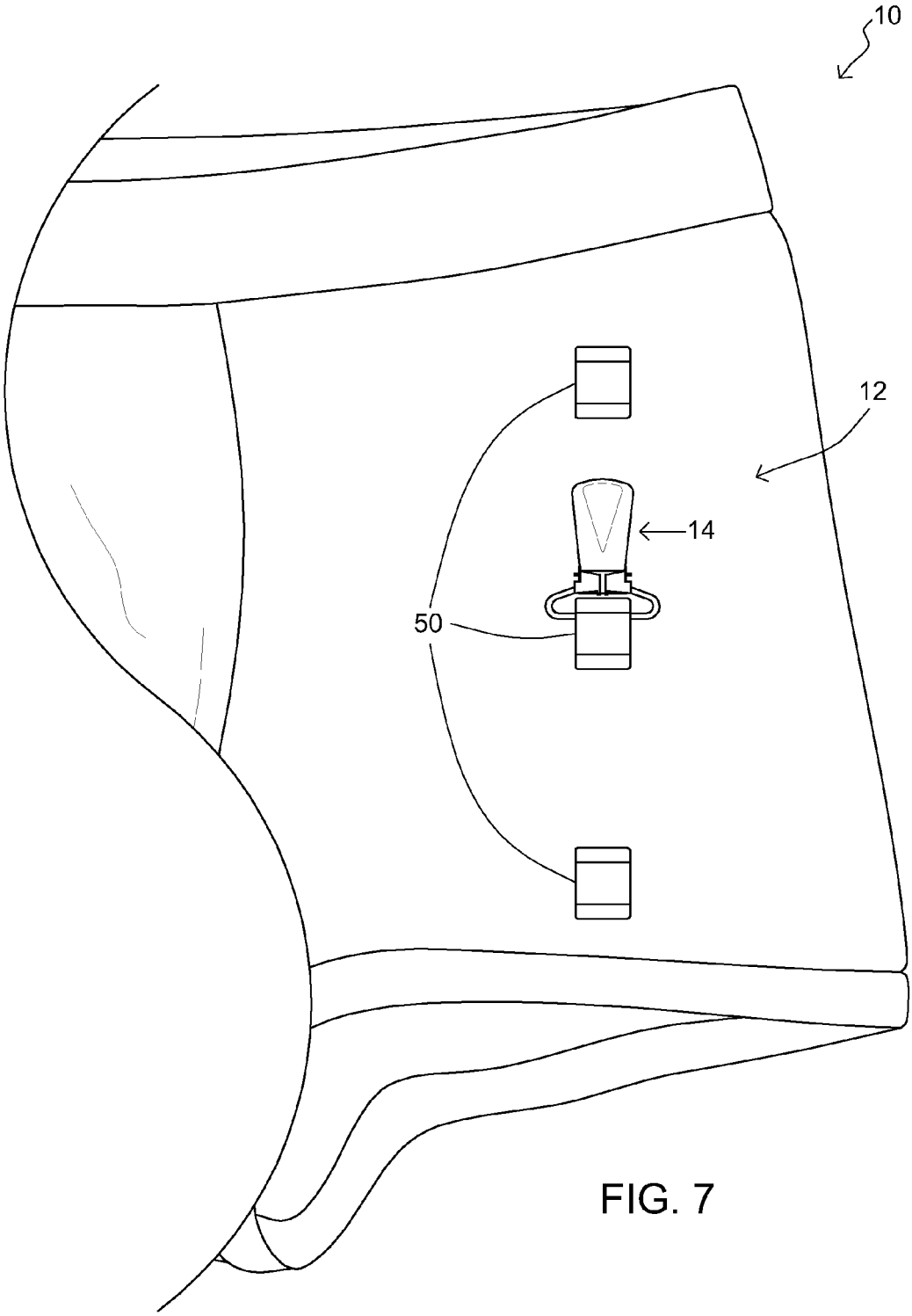
FIG. 7 is a partial front elevational view of an undergarment, according to one embodiment of the invention.

FIG. 7 is a partial front elevational view of an undergarment, according to one embodiment of the invention. There is shown an undergarment 10 including a loop system 12 and an attachment member 14.

The undergarment 10 includes a loop system 12 extending outwardly from a non-crotch area of the undergarment 10. The loop system 12 includes a plurality of elongated members each forming successive independent loops 50 having differing heights up the undergarment 10, wherein the successive independent loops 50 are coupled to the undergarment 10 in a vertical configuration. The illustrated successive independent loops are stitched to the exterior surface of the undergarment. The illustrated successive independent loops are vertically spaced up the undergarment and do not include structure configured to permit the attachment member 14 to freely travel between loops without decoupling therefrom.

The illustrated undergarment 10 includes an attachment member 14 coupled to the loop system 12, wherein a user selects one of the independent loops 50 and couples the attachment member 14 thereto, depending on the height necessary to couple a second garment thereto. The attachment member 14 includes a clip configured to selectably couple to a second garment. The attachment member 14 includes a coupling device coupled to the clip and selectably coupleable to the loop system 12 at one of the independent loops 50. The loop system 12 includes a plurality of loops 50 extending from a pair of front portions and from a pair of back portions of the undergarment 10.

Figure 8:
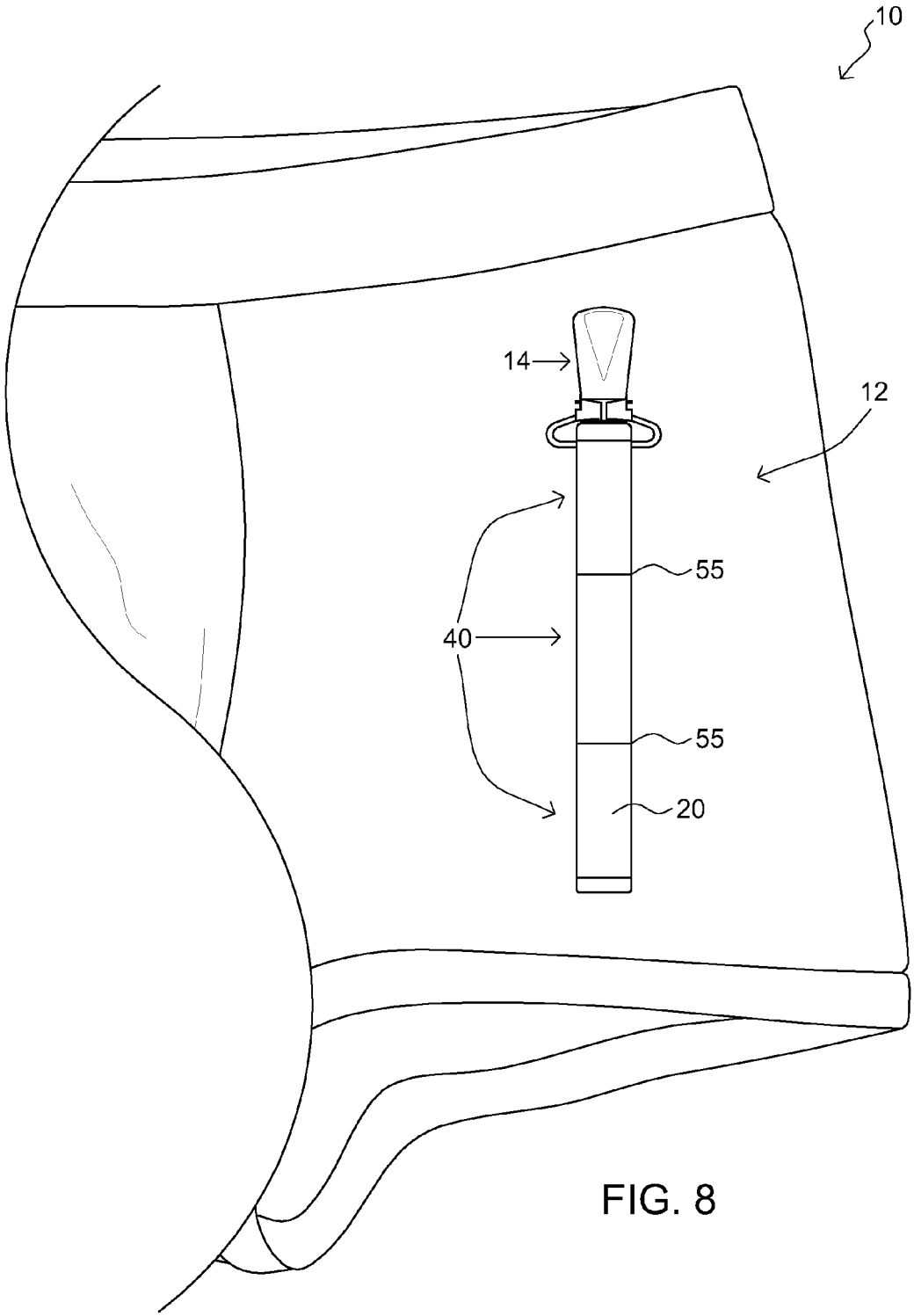
FIG. 8 is a partial front elevational view of an undergarment, according to one embodiment of the invention.

FIG. 8 is a partial front elevational view of an undergarment, according to one embodiment of the invention. There is shown an undergarment 10 including a loop system 12 and an attachment member 14.

The illustrated undergarment 10 is configured to be worn about the hip region of a user. The undergarment 10 includes a loop system 12 extending outwardly from a non-crotch area of the undergarment 10. The loop system 12 includes a plurality of anchor modes 40 having differing heights up the undergarment 10. The illustrated loop system 12 includes a single elongated member 20 separated into a plurality of successive independent loops by stitching and configured to selectably couple to an attachment member 14. The attachment member 14 includes a clip configured to selectably couple to a second garment. The attachment member 14 also includes a split ring coupled to the clip and selectably coupleable to the loop system 12 at one of the plurality of anchor modes 40.

The illustrated elongated member 20 is coupled vertically to the undergarment 10 at a plurality of spaced positions 55, thereby forming successive independent loops. The loop system 12 includes a plurality of elongated members 20 extending from a pair of front portions and from a pair of back portions of the undergarment 10.

Figure 9:
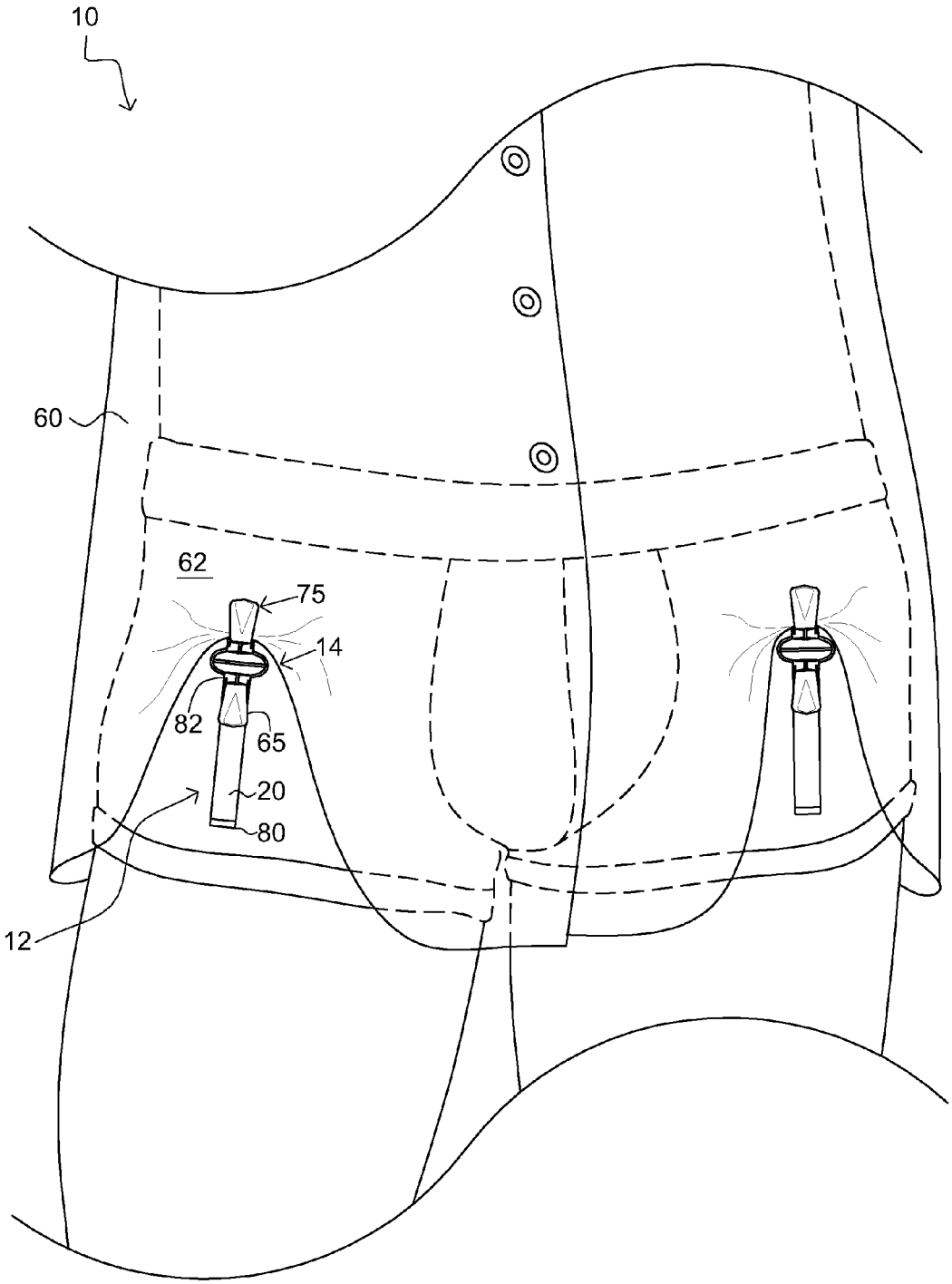
FIG. 9 is a front perspective view of an undergarment coupled to a second garment, according to one embodiment of the invention.

FIG. 9 is a front perspective view of an undergarment coupled to a second garment, according to one embodiment of the invention. There is shown an undergarment 10 including a loop system 12 and an attachment member 14 coupled to a second garment 60.

The illustrated undergarment 10 is configured to secure a second garment 60, such as a shirt, thereto. The undergarment 10 includes a loop system 12 extending outwardly from a non-crotch area of the undergarment 10. The loop system 12 includes an elongated member 20 configured to couple to the undergarment 10 at a first end 80 and at a second end 82, wherein the elongated member 20 in between the first end 80 and the second end 82 is not coupled to the undergarment 10. The attachment member 14 is configured to selectably couple to the elongated member 20 at varying heights. The illustrated attachment member 14 includes a first clip 75 configured to selectably couple to a portion of the shirt 62 of the second garment 60. The illustrated attachment member 14 also includes a second clip 65 coupled, and disposed opposite of the first clip 75 and selectably coupleable to the elongated member 20 of the loop system 12. The second clip 65 is configured to couple to the elongated member 20 and secure the attachment member 14 thereto. The second clip 65 is configured to move vertically about the elongated member 20 and couple thereto at a desired location.

Figure 10:
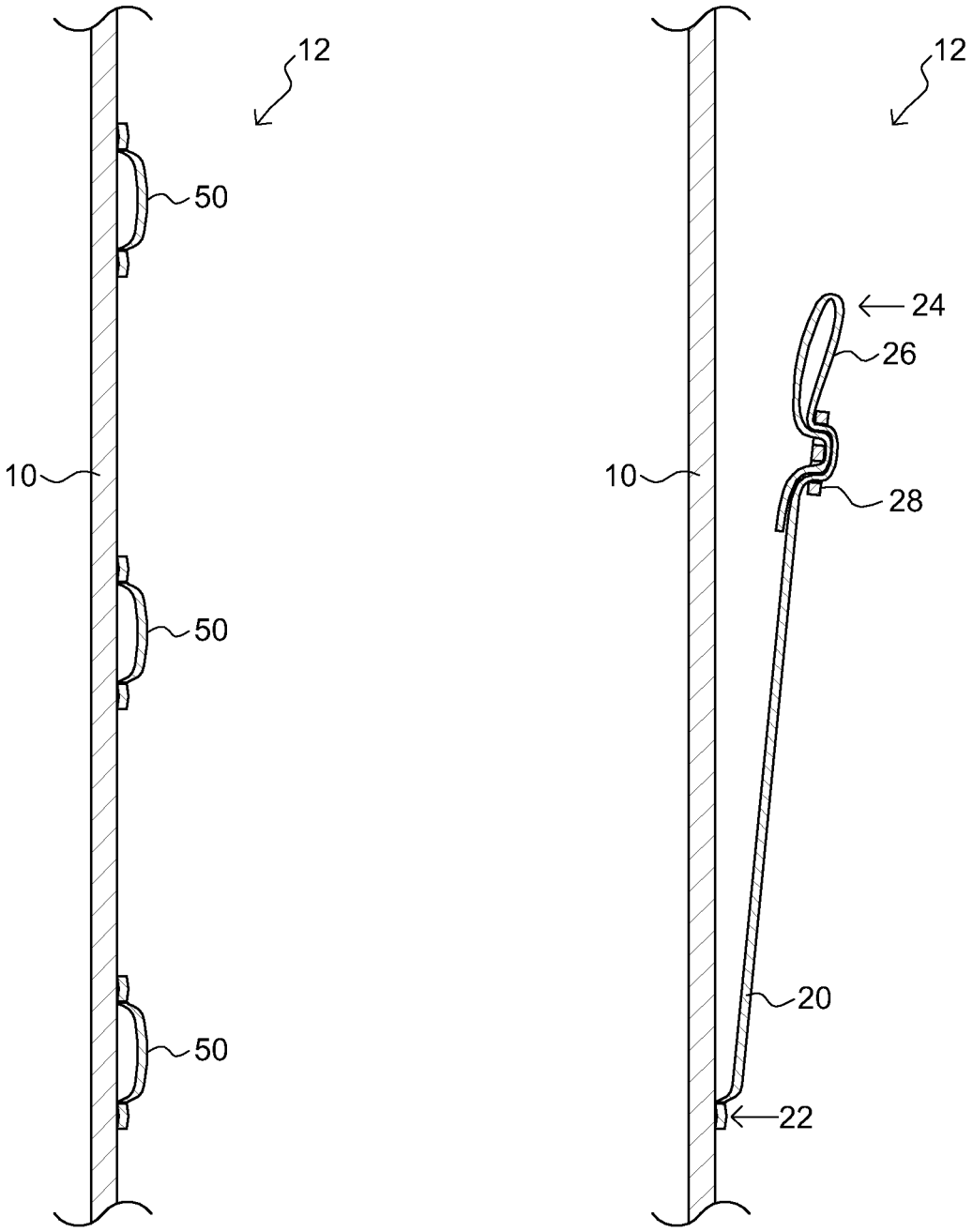
FIG. 10 is a pair of partial side cross-sectional views of an undergarment, according to one embodiment of the invention.
Figure 11:
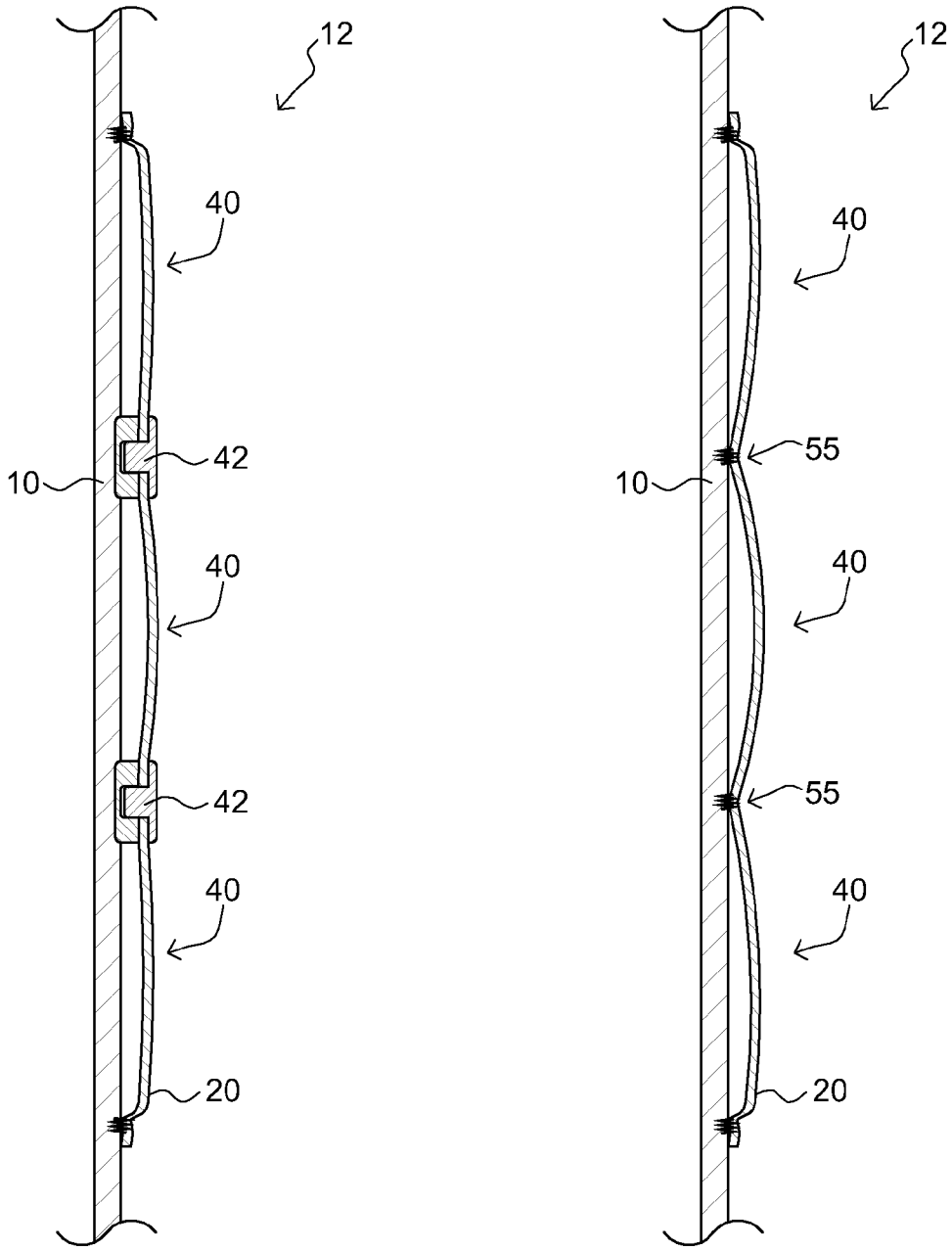
FIG. 11 is a pair of partial side cross-sectional views of an undergarment, according to one embodiment of the invention.

FIGS. 10 and 11 illustrate a set of pairs of partial side cross-sectional views of an undergarment, according to one embodiment of the invention. There is shown an undergarment 10 including a loop system 12.

The illustrated undergarment 10 is configured to secure a second garment thereto and is shaped to be worn about the hip region of a user. The undergarment 10 includes a loop system 12 extending outwardly from a non-crotch area of the undergarment. As illustrated in FIG. 11, the loop system 12 includes a plurality of anchor modes 40 having differing heights up the undergarment 10. As illustrated in FIG. 10, the loop system 12 includes a plurality of successive independent loops 50 configured to provide differing heights to couple an attachment member thereto.

As illustrated in FIGS. 10 and 11, the loop system 12 includes an elongated member 20 coupled vertically to the undergarment 10. As illustrated in FIG. 11, the elongated member 20 includes an internal attachment device 42 configured to selectably attach to the undergarment 10. The internal attachment device 42 may be detached, thereby connecting the successive independent loops. The illustrated elongated member 20 is coupled vertically to the undergarment 10 at a plurality of spaced positions 55, thereby forming successive independent loops.

As illustrated in FIG. 10, the loop system 12 includes an elongated member 20 coupled to the undergarment 10 at a first end 22 and having a second end 24 including a loop 26. The loop 26 is configured to support an attachment member configured to couple the undergarment to a second garment. As illustrated in FIG. 10, the elongated member 20 includes a length adjustment device 28 configured to selectably adjust an effectual height of the attachment member extending therefrom. The loop system 12 includes a plurality of loops, such as elongated members 20 or successive independent loops 50 configured to extend from a pair of front portions and from a pair of back portions of the undergarment 10.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the Figures illustrate a split ring or a coupling device, one skilled in the art would appreciate that the split ring or coupling device may include Velcro, configured to couple the attachment member to the loop system and still perform its intended function.

Additionally, although the figures illustrate a clip, one skilled in the art would appreciate that the clip includes a gripping device configured to securely couple to a second garment. The gripping device may be configured to secure to the second garment without damaging the garment, and still perform its intended function.

It is envisioned that, one skilled in the art would appreciate that the loop system, the elongated members, the attachment members, the successive independent loops, the length adjustment devices may be used in any combination with each other, in any amount, and in any configuration and still perform its intended function.

It is expected that there could be numerous variations of the design of this invention. A non-limiting example is that the vertically spaced anchor modes may be disposed diagonally. Further, the illustrated loop systems may be used in combination one with the other. More, loop systems may be anchored along an exterior thigh portion of an undergarment.

Finally, it is envisioned that the components of the device may be constructed of a variety of materials, such as but not limited to textiles, fabrics, clothes, garments, metal alloys, plastic, plastic composites, metals, etc. and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. An undergarment configured to secure a second garment thereto, comprising:

a) an undergarment shaped to be worn about the hip region of a user;

b) a loop system extending upwardly from an exterior of a non-crotch area of the undergarment; and c) an attachment member coupled to the loop system, including:

c1) a clip configured to selectably couple to a second garment; and c2) a split ring coupled to the clip and selectably coupleable to the loop system.

2. The undergarment of claim 1, wherein the loop system further includes an elongated member coupled vertically to the undergarment at a plurality of spaced positions, thereby forming successive independent loops.

3. The undergarment of claim 2, wherein the elongated member includes an internal attachment device configured to selectably attach to the undergarment, thereby connecting successive loops, wherein the internal attachment device is detached.

4. The undergarment of claim 1, wherein the loop system further includes a plurality of successive independent loops.

5. The undergarment of claim 1, wherein the loop system further includes an elongated member coupled to the undergarment at a first end and having a second end including a loop.

6. The undergarment of claim 5, wherein the second end includes a length adjustment device configured to selectably adjust an effectual height of the clip extending from the second end.

7. The undergarment of claim 1, wherein the loop system further includes a plurality of elongated members, each having a first end and a second end; wherein each of the first ends of the plurality of elongated members is coupled on the undergarment at a same location; wherein each of the second ends of the plurality of elongated members have a different effective height.

8. The undergarment of claim 1, wherein the loop system includes a plurality of loops extending from a pair of front portions and from a pair of back portions of the undergarment.

9. An undergarment configured to secure a second garment thereto, comprising:

a) an undergarment shaped to be worn about the hip region of a user;

b) a loop system extending upwardly from an exterior of a non-crotch area of the undergarment; and c) an attachment member coupled to the loop system, including:

c1) a first coupling device configured to selectably couple to a second garment; and c2) a second coupling device coupled to a clip and selectably coupleable to the loop system.

10. The undergarment of claim 9, wherein the loop system further includes an elongated member coupled vertically to the undergarment at a plurality of spaced positions, thereby forming successive independent loops.

11. The undergarment of claim 10, wherein the elongated member includes an internal attachment device configured to selectably attach to the undergarment, thereby connecting successive loops, wherein the internal attachment device is detached.

12. The undergarment of claim 9, wherein the loop system further includes a plurality of successive independent loops.

13. The undergarment of claim 9, wherein the loop system further includes an elongated member coupled to the undergarment at a first end and having a second end including a loop.

14. The undergarment of claim 13, wherein the second end includes a length adjustment device configured to selectably adjust an effectual height of the clip extending from the second end.

15. The undergarment of claim 9, wherein the loop system further includes a plurality of elongated members, each having a first end and a second end; wherein each of the first ends of the plurality of elongated members is coupled on the undergarment at a same location; wherein each of the second ends of the plurality of elongated members have a different effective height.

16. The undergarment of claim 9, wherein the loop system includes a plurality of loops extending from a pair of front portions and from a pair of back portions of the undergarment.

* * * * *